US005085013A

United States Patent [19]

Ascosi et al.

[11] Patent Number: 5,085,013

[45] Date of Patent: Feb. 4, 1992

[54] CONTACT LENS ORIENTATION METHOD AND APPARATUS

[76] Inventors: Vito S. Ascosi, 16043 Dorset Rd., Laurel, Md. 20707; Robert O. Breece, 4811 Mercury Dr., Rockville, Md. 20853

[21] Appl. No.: 507,774

[22] Filed: Apr. 12, 1990

[51] Int. Cl.[5] ..... B23B 3/00

[52] U.S. Cl. ..... 51/277; 51/217 L; 51/284 R; 279/46 R; 279/41 R; 82/12

[58] Field of Search ..... 82/12, 165; 279/41 R, 279/42, 43, 46 R; 51/277, 216 LP, 217 L, 217 T, 284 R

[56] References Cited

U.S. PATENT DOCUMENTS 2,441,472 5/1948 d'Avaucourt ..... 51/277 X
3,100,955 8/1963 Kratt ..... 51/217 R
3,501,842 3/1987 Beasley ..... 51/277
3,662,040 5/1972 Urbach et al. ..... 51/284.12
4,679,471 7/1987 Wauchope et al. ..... 82/12

*Primary Examiner*—D. S. Meislin
*Attorney, Agent, or Firm*—Richard C. Litman

[57] ABSTRACT

An improved method of making contact lenses that involves using an improved arbor for holding the lens. The arbor assembly includes the use of a surrounding ring having a diametrical slot that mates with pins on various orientation and cutting machines to allow operators of these machines to easily and precisely align certain marked features of the lens blank in relation to features of the various cutting machines. The marking is done with a mechanical marker for more accurate marks of the features.

3 Claims, 3 Drawing Sheets

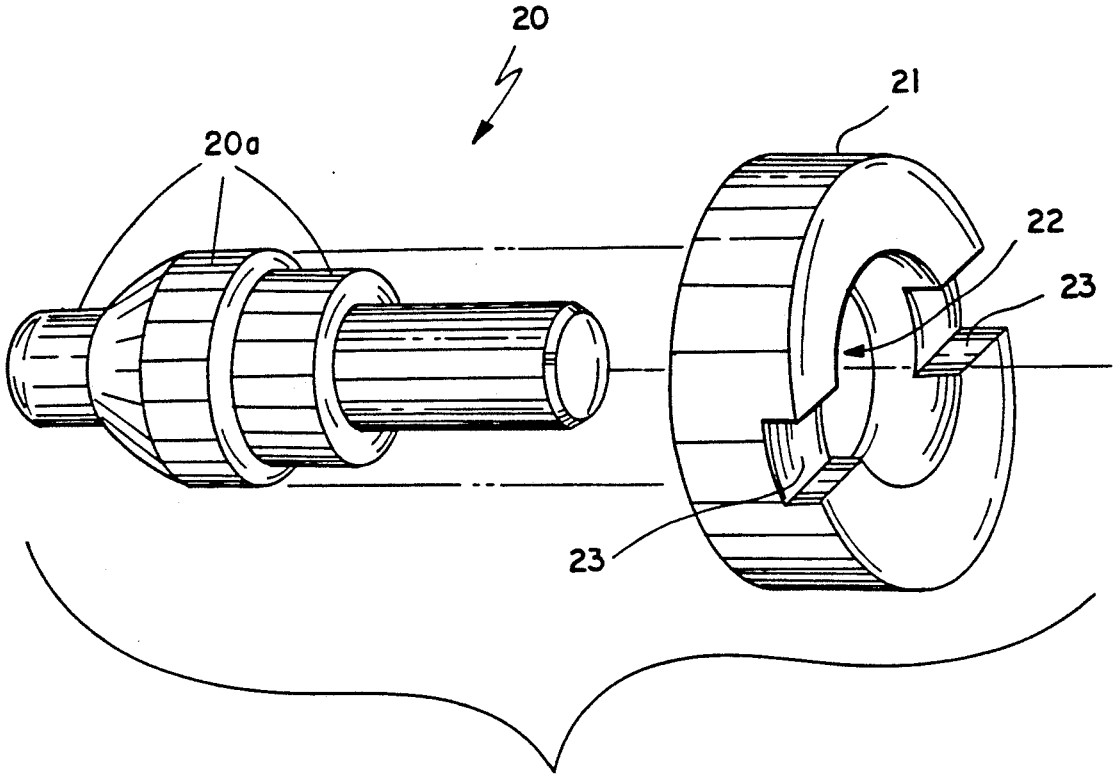
FIG. 1
FIG. 2
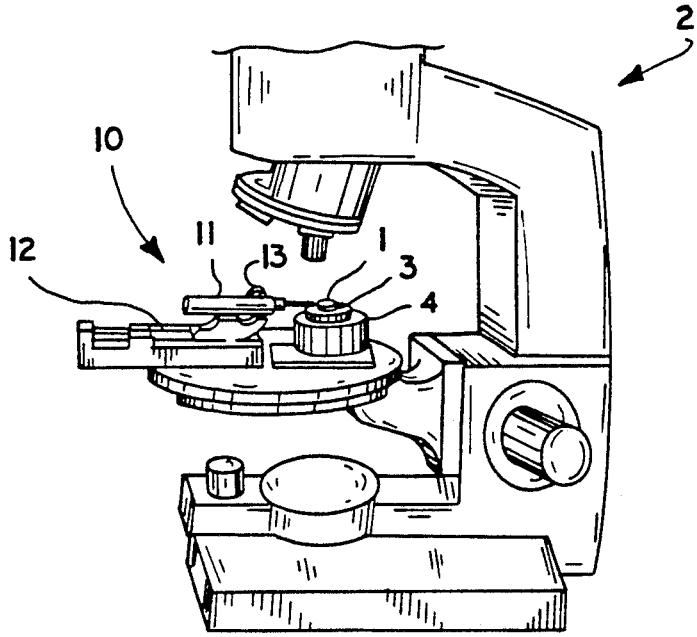

CONTACT LENS ORIENTATION METHOD AND APPARATUS

BACKGROUND OF THE INVENTION

1. Field of the Invention

The present invention relates to methods of preparation and cutting of contact lenses. In particular it relates to a method of precisely orienting and affixing a device to determine the position of a contact lens during fabrication of that lens. Present methods include marking the lens (or the lens mount) and aligning this mark with a mark on a holding device. Another method is to attach the lens to its mount in a specific manner. These methods are less precise, more cumbersome, and more variable than the method which is the subject of this patent. After these initial steps, additional cuts must be made so that the lens orients upon the eyeball in a proper and comfortable fashion. This involves various cuts that require precise knowledge of the angular orientation of the lens. These cuts also involve 180 degree flips or rotations of the lens in order to perform an exact duplicate cut on a reverse side of the lens or movement from one offset collet to another without displacement of orientation.

This second section of the lens preparation, up till now, was usually done without any sophisticated marking or holding equipment. A lens was usually placed in a radiuscope and the major axes of the lens curvature or meridians were marked out by hand. This led to imprecision, the usual allowable tolerance being 2 to 10 degrees. The orientation for the axes marks for the cutters with the lens blocked to an arbor was also done by hand, the cutter visually positioning the lens marks in order to perform the necessary positioning and repositioning of the lens. A more precise and consistent method of marking and orienting the lens is necessary to reduce imprecision and the cost of discarded lenses.

2. Description of the Prior Art

The following is a discussion of patents for inventions related to the present invention, but not disclosing it as such, either singly or in combination.

U.S. Pat. No. 3,100,955 issued to Kratt discloses an apparatus for producing contact lenses comprising a lens blank holding tool which maintains an orientation flange around the lens during the cutting and polishing operations. The holding tool insures maintenance of a proper optical axis for the surfaces of the lens as to axial alignment.

U.S. Pat. No. 3,501,842 issued to Beasley discloses a method and apparatus for blocking a multifocal lens blank in a predetermined relationship to the desired optical properties of the lens according to a particualr prescription. The block is then secured to the lens blank during the grinding and polishing or edging operations.

U.S. Pat. No. 3,662,040 issued to Urbach et al. describes a technique for making multifocal contact lenses employing a conventional radius turning lathe having two supports, one for the lens blank and the other for the tool. The tool is rotated about an axis fixed on its support to that its point describes a circle while the blank is held fixed in a support movable about a center traverse or perpendicular to the tool axis. By the disclosed technique multifocal areas of the lens may be provided that fall on a common axis.

SUMMARY OF THE INVENTION

One aspect of the present invention consists of a novel holding arbor for a contact lens blank to be used in conjunction with a lens grinding and cutting machine with a unique surrounding ring having an alignment means that comprises a slot that crosses the ring. The central arbor and ring are separable so that the axes orientation marks on the lens blank can be positioned with respect to the ring slot.

Another aspect of the invention includes an improved marking system for the lens blank. While an unfinished lens is held in a specific orientation, a marking tool, fixed along a line passing through the center of the unfinished lens, is used to mark the lens. This marking tool is brought to the unfinished lens and leaves a precisely located mark on the lens. This mark usually indicates the position of one or more features of the unfinished lens. These features may include, but are not limited to: toricity of a refracting surface, bifocal power, prism power, etc. Previous to this the method used was marking by hand using the sight of the person marking as the only guide. The present method will eliminate most of the imprecision associated with sighting and marking something by eye alone.

Another aspect of this invention is a means of rotating and precisely orienting the ring with respect to the mark on the unfinished lens blank. This patent application describes one means whereby the unfinished lens, mounted on its arbor, is held in a known position and the surrounding ring is rotated around the lens to a specific position as determined by a measurement tool that shows the relative locations of the lens mark and the slot in the ring. The ring is then fixed to the arbor, thereby resulting in the lens mark being in a precise relationship to the slot in the ring.

The unfinished lens can be accurately oriented in different devices and tools used in fabricating the lens because these devices will have one or more protrusions, such as a pin, that are fixed to specific orientations of these devices. When these devices hold the arbor on which the unfinished lens is fixed and the ring has been oriented, the unfinished lens will have a precisely located position with respect to the protrusions on this device. As the unfinished lens, mounted on the ringed arbor, moves to different stages of manufacturing, the precise orientation of the lens can be repeated in different devices. These devices include, but are limited to: collets in cutting machines, holders in polishing machines, marking tools, etc.

Accordingly, it is one object of the present invention to provide an improved method of preparing an unfinished contact lens for a prescription.

It is another object of the present invention to provide an improved contact lens mounting arbor and slotted ring and a means of accurate positioning of the slot around the contact lens.

It is a further object of the present invention to provide an improved mark to identify a unique position of the contact lens.

It is a still further object of the present invention to provide an improved means of locating features of the unfinished contact lens blank reliably and with ease throughout different manufacturing steps.

These and other objects of the present invention will become readily apparent upon further review of the following specification and drawings.

BRIEF DESCRIPTION OF THE DRAWINGS

FIG. 1 shows an exploded view in perspective of the lens arbor and the holding ring.

FIG. 2 shows a perspective side view of the radiuscope and marking tool.

Similar reference characters denote corresponding features consistently throughout the attached drawings.

A DETAILED DESCRIPTION OF THE PREFERRED EMBODIMENT

The improved method for fabricating a contact lens comprises some steps that are known in conventional practice and will not be the object of this discussion except to note their inclusion as part of the improved process of prescription contact lens preparation.

Figure 5A:
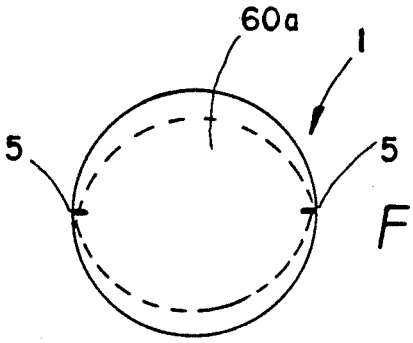
FIG. 5*a* shows a top view of a typical back surface lens cut pattern with the alignment mark for the cutter.
Figure 5B:
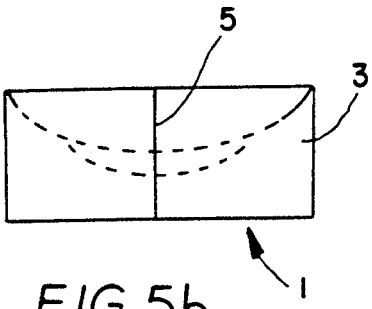
FIG. 5*b* shows a side view of a lens blank with alignment mark.

After a feature, such as a toric surface has been fabricated into the unfinished lens blank, the lens must be marked to identify the location of this feature. For example, a radiuscope 2 is used to position the axes of curvature of the toric surface along a grid line visible in the radiuscope. The radiuscope 2 is a known conventional piece of equipment. The marking prior to the present invention was usually done by hand on the side of the lens 3, a very imprecise procedure. The improvement here comprises the use of a mechanical device 10 that travels along a path fixed in relation to the located feature, in this case along a line coinciding to the grid line of radiuscope 2, until it contacts the lens blank wall 3 and leaves a mark. The use of a mechanical marker 10 allows consistent positioning of the mark. This mechanical marking device 10 shown in FIG. 2 comprises a marker or pen 11 mounted on a track 12 by a clamp 13. The radiuscope 2 has a rotating seat 4 for the lens 1 so that the features can be lined up while looking through the radiuscope 2. The internal grid inside the radiuscope 2 corresponds to the alignment marking point 5 on the lens side 3. Once these features are lined up, the marker 11 is urged forward on the track 12 so that a small mark 5, shown in FIG. 5*b*, is left on the side of the lens 3. The use of a mechanical marker 10 allows more consistent positioning and accuracy than previous methods because its path is fixed by track 12. After this marking step, the lens 1 is blocked to an arbor 20 in a known conventional manner. The blocking involves seating the lens 1 on the end of the arbor 20 usually with an adhesive such as bee's wax or dental wax 6.

Figure 3A:
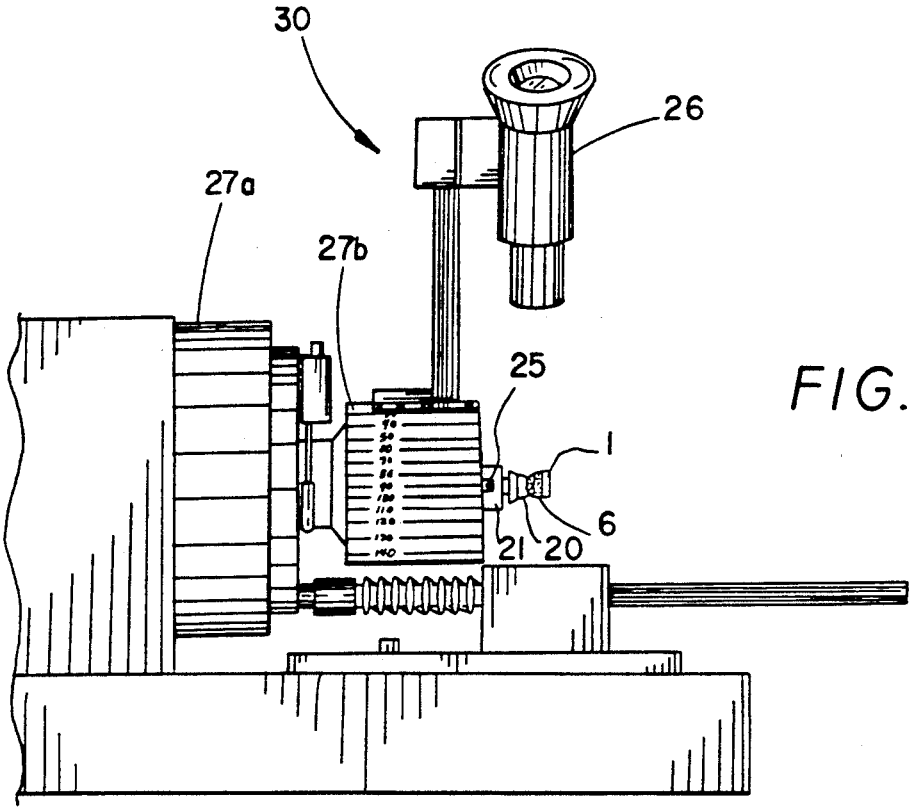
FIG. 3*a* shows a side view of the orientation device.
Figure 3B:
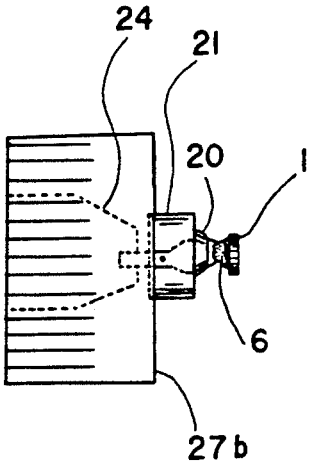
FIG. 3*b* shows a top view of the orientation device showing the holding collet in outline.

Following the lens blocking, the arbor 20 will be inserted through and affixed to a slotted ring 21 shown in FIG. 1 by means of an orientation blocker 30 shown in FIGS. 3*a* and 3*b*. The arbor 20 with mounted lens 1 is inserted through the central hole 22 of the ring 21. Slot 23 crosses ring 21 in a diametric fashion. The arbor 20 is held by collet 24 shown by hidden lines in FIG. 3*a* and 3*b*. The ring 21 is held stationary by the pin 25 on an orientation collar 27*b* which surrounds the collet 24. FIG. 3*b* shows more detailed view of the shape of the collet 24 in outline. The pin 25, mounted on collar 27*b* in a fixed position, snugly rests inside the slot 23. A scope 26 is used to closely monitor the marked lens wall 3. Rotating the collet 24 by turning wheel 27*a* aligns the marked lens wall 2 in a fixed relation with the slot 23 on the ring 21. The spring bar 53 then locks this position. Collar 27*b* has graduated degree marks on its outer surface and a frontal area which contains ring 21 locking into pin 25 which controls at which axis the ring 21 and arbor 20 are to be aligned using the mark 5 to reference the arbor. Once aligned, the ring 21 is pushed onto the arbor 20 by retracting the collet 24 that holds the arbor 20. The ring 21 and the arbor 20 snap fit tightly together, the ring 21 abutting the widened end of arbor 20*a*. With this fixed aligned lens 1 and arbor assembly 20, the operators of the different devices used to fabricate the contact lens will easily be able to orient the features of the unfinished lens in specific and precise manners.

Figure 4A:
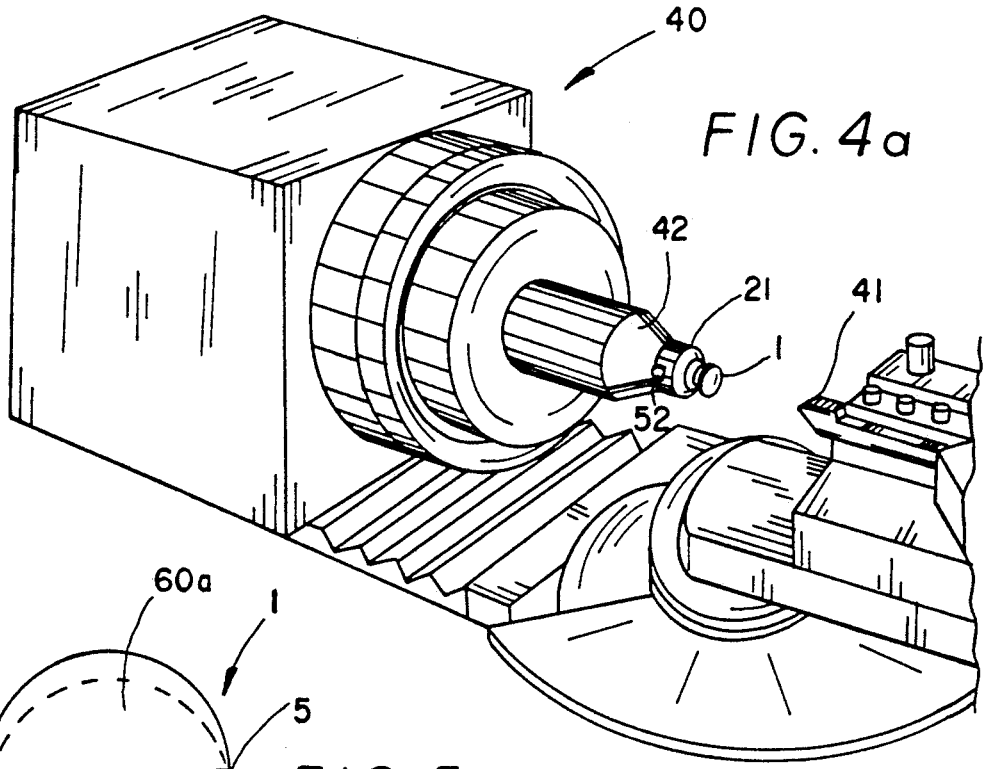
FIG. 4*a* shows a perspective view of the cutter with collet.
Figure 4B:
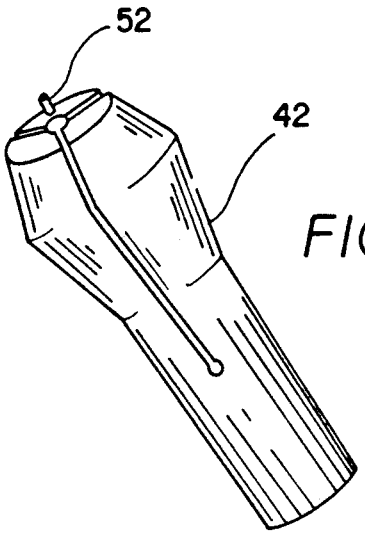
FIG. 4*b* shows a perspective view of the collet detailing the position of the pin.
Figure 7:
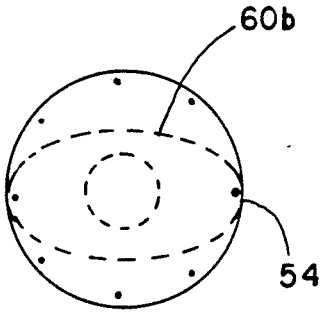
FIG. 7 shows an elevational view of a typical front surface cut pattern.
Figure 8:
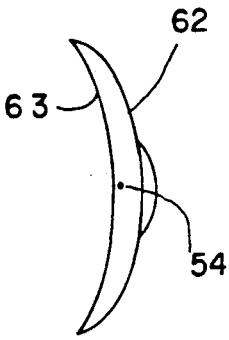
FIG. 8 shows a side view of a completed lens.
Figure 6:
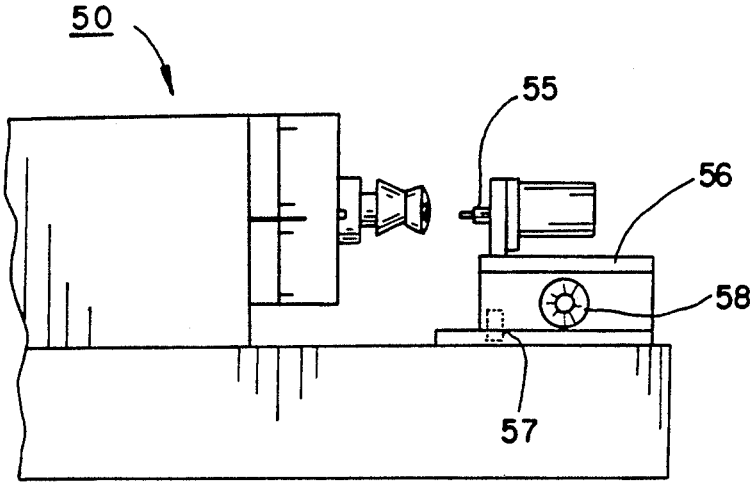
FIG. 6 shows a side view of the front surface orientation marker.

The cutting device 40 with blade 41 is shown in FIG. 4*a*. A closer view of the cutting collet 42, which is similar to collet 24, with the pin 52 is shown in FIG. 4*b*. Many of the final cuts involve patterns that are certain degrees opposite one another or offset. These cuts or surface ballasting as they are known are for the final proper seating of the lens 1 on the eyeball. FIG. 8 shows what a completed lens 1 should look like having front 62 and back 63 surfaces. FIG. 5*a* shows a back surface cut pattern 60*a* with the initial alignment marks 5 to be used by the mating device. A typical front surface cut pattern 60*b* is shown in FIG. 7. Note the orientation marks 54 and their placement with respect to the cut pattern. The description of these orientation marks 54 will follow with the description of FIG. 6. A degree of accuracy or tolerance of 2 to 10 degrees of rotation is the most allowable for these cuts depending upon the amount of cylinder. Previous to the slotted ring system described here, these placements and cuts were done by hand and eye alone. Now the arbor device 20 and 21 is placed in the cutting collet 42 with the pin 52 tightly resting in the slot 23. Once a final cut is performed on one side of the lens 1, the cutter can take the lens arbor 20 and ring 21 and flip it 180 degrees so that the pin 52 rests in the opposite side of the slot 23. This allows for a near perfect placement of the lens 1 as compared to the hand and eye method used before. It also ensures the repeatiblity of the process due to no displacement when the lens 1 and arbor 20 are moved from one offset collet to another.

It shoud be stated that the radiuscope 2 and cutting machines 40 in themselves are not new; it is the addition of features such as the marking device 11 and the pin on the machines and the slot 23 on the ring that give improved quality in the lenses being produced. The lens orientation device 30 is a new construct, unique for the purpose of aligning and mating the ring 21 and arbor 20 together with the attached lens 3. Another possible embodiment is to have ridges instead of pins used for the mating means.

To ensure the accurate fit of a contact lens, orientation marks 54 are placed on the front surface 62 of the lens to enable the customer to read any displacement, change or difference in axial alignment. This is a common way of marking lenses, but the difference being that these marks are positioned by mating the ring 21 with the orientation marking machine 50 in FIG. 6. This machine is similar to the machine shown in FIGS. 3*a* and 3*b*, but includes a marking device 55. The marking device is mounted upon a carriage 56 that pivots about a joint 57. The marker 55 is adjustable for depth by rotating dial 58. The marking device may also use a fiber optic laser alignment system to help align the marker 55 for the proper orientation marks 54.

It is to be understood that the present invention is not limited to the sole embodiment described above, but encompasses any and all embodiments within the scope of the following claims.

I claim:

1. In a lens cutting machine for producing prescription contact lens including a base, an arbor assembly for holding a contact lens, a rotatable collet adapted to be adjustably tightened about said arbor and lens cutting means for making surface cuts on a contact lens blank, the improvement comprising:

said arbor assembly consisting of an elongated arbor having one end adapted for placing a contact lens thereon and a ring having a central aperture and a diametrical slot on one face of said ring, said arbor being disposable through said central aperture and fixedly mating with said ring to align orientation marks on the contact lens blank in relationship to the diametrical slot on the ring; and said rotatable collet adapted to be adjustably tightened about said elongated arbor, said collet having a protrusion on one end thereof for mating with a periphery portion of said diametrical slot to perform a surface cut on a contact lens blank, wherein the arbor assembly may be made to rotate 180 degrees such that the protrusion on the collet mates with an opposite periphery portion of the diametrical slot for effecting a ballasting cut on an opposing surface of the contact lens blank.

2. In the lens cutting machine according to claim 1 wherein said elongated arbor includes a widened end portion that abuts said ring on a face opposite said face having the diametrical slot.

3. In the lens cutting machine according to claim 1 wherein said protrusion is a pin.

* * * * *